US006666929B1

(12) United States Patent
Ban

(10) Patent No.: US 6,666,929 B1
(45) Date of Patent: Dec. 23, 2003

(54) PROCESS FOR THE IMPROVEMENT OF THE MAGNETIC CHARACTERISTICS IN GRAIN ORIENTED ELECTRICAL SILICON STEEL SHEETS BY LASER TREATMENT

(75) Inventor: Gabor Ban, Terni (IT)

(73) Assignee: Acciai Speciali Terni, S.p.A., Terni (IT)

( * ) Notice: Subject to any disclaimer, the term of this patent is extended or adjusted under 35 U.S.C. 154(b) by 0 days.

(21) Appl. No.: 09/979,753

(22) PCT Filed: May 19, 2000

(86) PCT No.: PCT/EP00/04577

§ 371 (c)(1),
(2), (4) Date: Feb. 21, 2002

(87) PCT Pub. No.: WO00/73517

PCT Pub. Date: Dec. 7, 2000

(30) Foreign Application Priority Data

May 26, 1999 (IT) ..... RM99A0334

(51) Int. Cl.[7] ..... H01F 1/14; H01F 1/16
(52) U.S. Cl. ..... 148/111; 148/112; 148/110
(58) Field of Search ..... 148/110, 111, 148/112, 113

(56) References Cited

U.S. PATENT DOCUMENTS 4,952,253 A * 8/1990 Nishiike et al. ..... 148/113
5,411,604 A * 5/1995 Inokuti et al. ..... 148/112
6,423,156 B1 * 7/2002 Gunther et al. ..... 148/113

FOREIGN PATENT DOCUMENTS

| | | | |
|---|---|---|---|
| EP | 0 008 385 | 3/1980 | |
| EP | 0033 878 | 8/1981 | |
| EP | 0 087 587 | 9/1983 | |
| EP | 0 100 638 | 2/1984 | |
| EP | 0 087 587 B1 | 4/1989 | |
| EP | 0 611 829 A1 | 8/1994 | |
| GB | 2 128 639 A | 5/1984 | ..... 8/12 |

OTHER PUBLICATIONS

J. W. Schoen et al. "Domain Refinement Of Oriented Electrical Steel: From Early Beginnings To An Emerged Technology. "Paper presented at the 1986 ASM Materials Week Conference, Orlando, Florida, Oct. 4–9, 1986.

* cited by examiner

*Primary Examiner*—John Sheehan
(74) *Attorney, Agent, or Firm*—Morgan & Finnegan, LLP

(57) ABSTRACT

It has been found out that in the laser treatment for the control of the magnetic domain sizes in grain oriented electrical silicon steel sheets, by optimizing some essential parameters of the treatment such as specific radiation energy, the distance among the scribed traces, the scanning speed and the dwell time, a contemporaneous improvement of the magnetostriction, induction and core losses can be obtained.

12 Claims, No Drawings

PROCESS FOR THE IMPROVEMENT OF THE MAGNETIC CHARACTERISTICS IN GRAIN ORIENTED ELECTRICAL SILICON STEEL SHEETS BY LASER TREATMENT

FIELD OF THE INVENTION

The present invention refers to a process for the improvement of magnetic characteristics in grain oriented electrical silicon steel sheets by laser scribing, and more particularly it refers to a radiation process of the steel sheet after final annealing, in order to improve its induction characteristics, losses and magnetostriction with respect to the non-treated steel sheet.

STATE OF THE ART

Grain oriented electrical silicon steel sheets are mainly used in the manufacturing of cores for transformers; in this use, one of the most studied magnetic characteristics of the material, particularly after the oil crisis of the Seventies and more recently according to the increasing interest in energetic saving, is the one related to the so-called core losses, or losses, that is to say related to the quantity of energy lost during the working of the transformer. Losses are expressed in watt by kg of weight of the core and depend on various factors and particularly by the movement of the magnetic domain walls, defined as areas within the material wherein electrons responsible for the ferromagnetism have parallel spins and therefore a magnetic moment which is not null. In silicon magnetic steel sheets, the magnetic moment within a single domain is oriented according to the directions of easy magnetization, that is to say according to the crystallographic directions <100>. Domain walls are areas among adjacent domains through which the magnetic moment rotates and they are characterized by the value of this rotation, therefore we are talking about 180° and non-180° walls (in this material 90°).

In the demagnetized status, the vectorial sum of the magnetic moments is zero, below an external applied field, initial magnetization essentially takes place by movement of the domain walls, the ones being favorably oriented with respect to the applied field, take less energy and grow at the expenses of the other domains by lateral movement of the walls at 180°. A higher mobility of the walls makes magnetization easier and therefore the movement of the walls needs less energy. Energetic consumption associated with the movement of the walls at 180° is due to the electromotive forces generated by the movements of the walls opposing to this movement.

It has been found out that such component of the losses is proportional to the ratio between the distance among 180° walls and the thickness of the steel sheet. Moreover, it has been found out that losses also depend on the size of the steel sheet grains and on the orientation of the crystalline lattice of the grain with respect to the steel sheet surface.

Therefore the most obvious and immediate choice consists in the fact of having high-oriented grain silicon steel sheets having given grain sizes and a low thickness.

Efforts which have been made up to now have produced excellent results, which cannot be further improved in a considerable way from the manufacturing point of view; particularly, it has been found out that the optimum size of the grains is around 4 mm, while as far as the thickness of the steel sheet is concerned, going below some values is unsuitable both for the cost of these processes and because the ratio (called "space factor") between the volume of the steel sheet and the one of the needed insulating coatings decreases too much, therefore a considerable part of the core would be occupied by the insulating coating.

Therefore, other factors influencing the losses of the core have been taken into consideration and particularly the ones related to magnetic domain sizes.

First, it has been found out that applying a tension to the steel sheet an anisotropy is induced in the steel sheet plane which, in the presence of the typical structure of these materials (Goss texture) increases the magnetization energetic difference between the crystallographic direction <100> parallel to the rolling direction and the direction <011> perpendicular to the rolling direction. Consequently, the balance between the magnetostatics energy and the one of the domain walls shifts in favor of the wall energy, thus causing the formation of a high number of walls becoming thinner and closer. In such a way, a considerable decrease of the eddy current contribution to the total value of the losses is obtained. Therefore, tensioning insulating coatings have been developed able to obtain such improvements.

However, since 1924, the opportunity that such tensions can be obtained also by creating localized compression microstresses has been also suggested. From this point of view, it has been proposed to submit the steel sheet to shot-peening or mechanical scribing with drills, blades or rolls equipped with relieves. These methods, even though effective and capable of giving heat treating-resistant improvements at high temperatures, have the drawbacks to be of difficult application from the manufacturing point of view and of destroying the steel sheet insulating coating thus exposing the same to fast oxidation therefore requiring another insulating coating and forming burs or relieves of the metals at the edges of the scribing or impressions, thus decreasing the space value of the core and making in the same short circuits more frequent.

A further step has been the one related to the treatment of the steel sheet surface with concentrated energetic pulses in the form of laser beams, electron beams, plasma and the like.

An article produced to "1986 ASM Material Week Conference" of Oct. 4–9, 1986 in Orlando, Fla. by J. W. Schoen and A. L. von Hollen having title "Domain refinement of oriented electrical steel: from early beginning to an emerged technology" clearly describes all the issues recalling the first experiences on the subject; particularly referring to laser scribing treatment.

On this matter, FIGS. 7 and 9—and their relevant discussion in the text—it is stated that the improvement obtained by refining magnetic domains can be connected to the magnetostriction condition after laser treatment as the magnetostriction change represents a quantitative measure of the non-180° walls proportion introduced in areas submitted to laser treatment; the best refining domain results are obtained with a magnetostriction increase. This situation can also be found in other documents; for instance in European Patent n. 87587, priority Jan. 25$^{th}$ 1980, a radiation process of electromagnetic steel sheet with laser beam. The invention consists in applying a liquid coating agent to the steel sheet after laser treatment and in annealing this coating at a temperature not higher than 600° C. This temperature limit is due to the fact that improvements on losses due to the laser-type treatments completely disappear at temperatures higher than 500–600° C. This patent states that the laser treatment effects are used not only in order to reduce losses, but also to improve magnetostriction; however, on this aspect, no convincing demonstrations of the results obtained are given; in fact, Table 1—the only one in which magnetostriction evaluations are given—shows that measures concerning magnetostriction are expressed as size variations under a mechanical load of 17 kg. Therefore, in this regard, it must be pointed out that, as it is well known, a mechanical traction improves the magnetostriction. Moreover, from the data reported, it can be noticed that the results according to the invention are lower, as long as magnetostriction is concerned, than the ones which can be obtained by simply applying the final insulating coating, without laser treatment. Therefore, the only advantage of the laser treatment is to improve the value of the total core losses.

European Patent Application n. 611.829 filed on Aug. $24^{th}$ 1994, refers to the electronic beam treatment of an electrical oriented grain steel sheet surface, in order to obtain a product (core of transformer) having improved characteristics in shape and acoustic emissions. The invention consists in the fact that the steel sheet, provided with final insulating coating, is radiated with an electron beam sent on the steel sheet in such a way to follow a continuous or discontinuous zigzag path, so that the electron beam traces correspond to the apexes of the zigzag path. Also in this process, the improvements obtained only concern losses, while values referred to the magnetostriction (excitation power and noise) can be compared to the ones of the non-treated strip and they are better only for the strip treated with a linear radiation of the electron beam. A further drawback related to the use of the electron beam consists in the fact that it is necessary to operate under high vacuum, an expensive condition being hardly obtained in continuous treatment plants. Finally, it must be noticed that in this document the best results are obtained with a treatment temperature of the electron beam-treated strip comprised between 600° C. and 800° C. at which temperatures, as it is known, benefits due to micro-tensions induced by the treatment are lost. Therefore it can be deduced that in this document the obtained improvements are essentially due to the tensioning effect of the final insulating coating, better coupled to the steel sheet owing to the grooves engraved in the glass film by the electron beam.

The state of the art we know, shows how the radiation treatment with laser or electron beam of oriented grain silicon steel sheet can result in effective improvements in the general characteristics of the losses, while as far as the magnetostriction and the noise are concerned, results can be at most compared to the ones being obtained with the common treatment methods, without radiation of the surface. Moreover, it must be considered that laser or electron beam plants have very high capitals and running costs and therefore they could not be completely justified only in relation to improvements in losses.

Therefore, scope of the present invention is to obtain a laser treatment of magnetic oriented grain steel sheets able to absolutely improve values of core losses, magnetostriction and induction measured at 800 A/m values (from now on B800).

Another scope of the present invention is to carry out the laser treatment in order not to damage the steel sheet insulating coating.

A further scope of the present invention is to avoid the additional cost—necessary up to now—of a final insulating coating of the steel sheet after the laser treatment.

DESCRIPTION OF THE INVENTION

The present invention relates to a process wherein a oriented grain silicon steel sheet having already undergone a secondary recrystallization final annealing and provided with an insulating coating, is treated with a continuous emission laser, for instance a $CO_2$ one having a wave length of 10.46 $\mu$m, continuously scanning the strip in motion in a generically transversal direction with respect to the motion direction of the same strip. The process is characterized by the fact that some previously chosen process parameters (that is to say specific radiation energy, dwell time and distance between two consecutive traces of the laser beam on the steel sheet) are contemporarily and continuously adjusted respectively within the ranges 0.1 and 25 mJ/mm$^2$, $1\times10^{-6}$ s and $1\times10^{-2}$ s, 2 and 12 mm, in order to optimize the improvement of at least one of the magnetic characteristics of the strip, chosen between induction and core losses, continuously measured before and after the laser beam treatment, and not to damage the glass film insulating coating.

In this context, with dwell time the time is meant for which a particular surface of the strip is radiated by the laser beam, dwell time being a function of the strip speed, of the laser beam scanning speed and of the transversal sizes of the laser beam.

The specific radiation energy is preferably comprised between 2 and 8 mJ/mm$^2$, and more particularly between 3 and 5 mJ/mm$^2$. As far as the dwell time is concerned, it must be preferably comprised between $1\times10^{-5}$ and $1\times10^{-3}$ s, and more particularly between 1 and $8\times10^{-4}$ s.

The distance between the two consecutive lines must be preferably kept in the range between 3,5 and 8 mm according to the average size of the grain; in our test very good results have been obtained at distance values between two consecutive lines 10–20% lower than the average grain size measured in the rolling direction of the strip.

Another very important factor is the scanning speed of the laser beam on the strip surface, depending on other parameters such as the translation speed of the steel sheet in the line and the distance among the scribed lines; therefore in different plants this parameter can have different values, still maintaining to optimum values the obtained magnetic characteristics; in the test carried out in laboratory, excellent results with scanning speeds comprised between 800 and 10,000 m/min have been obtained; in the industrial plant used, values commonly used are comprised between 1500 and 6000 m/min.

The laser beam transversal dimensions, or length of the spot, from which the dwell time depends, are comprised between 1 and 60 mm, preferably between 5 and 50 mm, with common values comprised between 7 and 40 mm.

As the scanning motion of the laser beam is produced by the rotation of a polygonal mirror sending the beam on a parabolic mirror from which it is finally transmitted to the strip, process parameters also depend on the rotation speed of the polygonal mirror; therefore, according to the invention, this rotation speed is comprised between 100 and 10,000 rev/min., preferably between 600 and 6,000 rev/min.

Process parameters can be adjusted in order to optimize the loss or magnetostriction improvement, obtaining also small improvements in the magnetic permeability value.

As there are no standard methods to measure the magnetostriction, relevant measure in this text have been carried out according to the method stated by G. Ban and F. Janosi in "Measuring system and evaluation method of DC and AC magnetostriction behaviour to investigate 3.2% SiFe G.O. electrical steels" Conference of Soft Magnetic Materials, SMM'12 Conf. Proc. Journal of Magn. and Magn. Mat., Vol. 160, (1996), 167–170.

The present invention will be now described in detail with reference to the following realization examples, mentioned as non limiting examples of the subject of the present invention.

EXAMPLE 1

A steel having 3.2% by weight of Si, of the kind commonly used for the production of steel sheets having high magnetic characteristics has been produced and transformed, according to known methods, in steel sheets having a thickness of 0.27 mm, coated with a conventional annealing separator constituted by MgO and annealed in a box furnace.

After the required final treatments, a product having the following magnetic characteristics has been obtained:

| P (1.5 T) (W/kg) | P (1.7 T) (W/kg) | $B_{800}$ (mT) | $\lambda_{(p-p)}$ (1.7 T) | $\lambda_{(p-p)}$ (1.9 T) |
|---|---|---|---|---|
| 0.71 | 0.94 | 1925 | 2.73 $10^{-7}$ | 8.48 $10^{-7}$ |

Strips covered With glass film and insulating coating (one for the conventional treatment and three for the one according to the present invention) have been radiated with laser beam in the following conditions:

TABLE 1

| Laserization method | | SP. radiation energy ($mJ/mm^2$) | Power (W) | Distance among lines (mm) | Scanning speed (m/min.) | Dwell time (s $10^{-4}$) |
|---|---|---|---|---|---|---|
| Comparison | | 5.80 | 1800 | 5.0 | 4000 | 3.30 |
| Invention | A | 2.49 | 600 | 4.8 | 3012 | 4.38 |
| | B | 3.32 | 600 | 4.8 | 3012 | 4.38 |
| | C | 4.15 | 600 | 4.8 | 3012 | 4.38 |
| | D | 30 | 600 | 4.8 | 3012 | 4.38 |
| | E | 0.1 | 600 | 4.8 | 3012 | 4.38 |
| | F | 35 | 600 | 4.8 | 3012 | 4.38 |

Therefore, on the materials obtained have been measured magnetic characteristics, rust susceptibility in correspondence of the radiated areas (indicated in oxidized cm per trace meter), the visibility of the traces of the laser beam on the steel sheet (indicated as a ratio between visible length and trace length), the magnetostriction $\lambda_{(p-p)}$ (as a maximum variation of the strip length). The measured values are indicated in table 2.

TABLE 2

| | Comparison | Invention A | B | C | D | E | F |
|---|---|---|---|---|---|---|---|
| ΔP (1.5T) % | 11.19 | 5.8 | 10.5 | 11.3 | 10.6 | 0.8 | 11.2 |
| ΔP (1.7T) % | 12.74 | 7.4 | 10.1 | 10.8 | 10.9 | 0.7 | 12.7 |
| $\Delta B_{800}$ mT | −7 | 7 | 2 | 0 | −3 | −1 | −7 |
| $\lambda_{(p-p)}$ (1.7T) $10^{-}$ | 4.38 | 4.09 | 2.02 | 2.32 | 5.15 | 4.65 | 4.39 |
| $\lambda_{(p-p)}$ (1.9T) $10^{-7}$ | 8.58 | 5.15 | 5.76 | 7.37 | 10.6 | 4.80 | 8.59 |
| Corrosion in NaCl 1% | 100 | 8 | 0 | 0 | 60 | 0 | 100 |
| Visibility of traces % | 1 | 0 | 0 | 0.5 | 0.75 | 0 | 1 |

EXAMPLE 2

A strip has been also treated by changing the dwell time. Data related to the test is reported in the following table 3.

It is clear that there is a strong dependency from the dwell time of the magnetic quality of the final product, particularly all the magnetic characteristics taken into consideration improve only in some cases.

For strips G and H, even though the dwell time is comprised within the fixed values, in the specific plant it was not possible to adjust in the best way other parameters such as the strip and the scanning speed of the laser beam.

For strips I and J, good results have been obtained for all the magnetic characteristics taken into consideration.

Finally, for strips K and L, even though null values related to the trace visibility and corrosion were obtained, little and also negative improvements connected to losses, negative improvements related to permeability and too high magnetostriction values have been noticed.

TABLE 3

| | Sample G | H | I | J | K | L |
|---|---|---|---|---|---|---|
| Dwell time (s) | 4.04 $10^{-5}$ | 9.71 $10^{-5}$ | 5.93 $10^{-4}$ | 1.02 $10^{-3}$ | 2.74 $10^{-3}$ | 3.56 $10^{-3}$ |
| ΔP % (1.5 T) | 9.7 | 7.0 | 5.1 | 5.1 | 0.5 | 1.3 |
| ΔP % (1.7 T) | 12.3 | 11.2 | 7.9 | 7.9 | 0.9 | −0.1 |
| $\Delta B_{800}$ | 10.4 | 5.6 | 2.6 | 2.6 | −3.4 | −9.4 |
| $\Delta_{(p-p)}$(1.7 T) | 2.8 | 2.0 | 2.7 | 2.7 | 7.1 | 9.0 |
| $\Delta_{(p-p)}$(1.9 T) | 8.6 | 6.6 | 7.8 | 7.8 | 11.4 | 16.6 |
| Visibility of traces | 1 | 0 | 0 | 0 | 0 | 0 |
| Corrosion in NaCl 1% | 100 | 20 | 0 | 0 | 0 | 0 |

EXAMPLE 3

A strip treated as in I has been submitted to further working by changing the distance between the traces. In the strip, the average size of the grain in the rolling direction was of 8.53 mm, with a variability of 30%. The obtained results are shown in Table 4. In this case also it is possible to notice that acceptable values are obtained throughout the examined field within the limits fixed for the operation parameters (except for the magnetostriction, at minimum for samples P and Q) and that optimum values can be obtained for a distance among lines comprised between 7 and 8 mm, that is to say 8–18% lower than the average sizes of the grain.

TABLE 4

| | Sample M | N | O | P | Q | R | S | T |
|---|---|---|---|---|---|---|---|---|
| Distance am. traces (mm) | 4 | 5 | 6 | 7 | 8 | 9 | 11 | 13 |
| ΔP (1.5T) % | 12.6 | 12.8 | 11.9 | 13.0 | 16.4 | 13.2 | 9.3 | 11.1 |
| ΔP (1.7T) % | 13.5 | 11.4 | 11.8 | 14.5 | 14.1 | 12.0 | 8.9 | 10.0 |
| $\Delta B_{800}$ | 3.2 | 3.7 | 4.8 | 8.1 | 9.4 | 3.1 | 5.0 | 5.3 |
| $\lambda_{p-p)}$ (1.7T) $10^{-7}$ | 8.6 | 7.0 | 5.0 | 3.2 | 2.2 | 11.0 | 10.0 | 9.0 |
| $\lambda_{(p-p)}$ (1.9T) $10^{-7}$ | 13.3 | 12.0 | 9.2 | 5.4 | 4.8 | 14.0 | 14.1 | 13.2 |
| Visibility of traces | 0 | 0 | 0 | 0 | 0 | 0 | 0 | 0 |
| Corrosion in NaCl 1% | 0 | 0 | 0 | 0 | 0 | 0 | 0 | 0 |

EXAMPLE 4

According to the present invention, magnetostriction was measured before and after laser treatment on a steel strip O, having a polarization field comprised between 0.8 and 1.9 T. The obtained results are shown in Table 5.

TABLE 5

| | Before laser treatment | After laser treatment |
|---|---|---|
| Polarization, T | Magnetostriction λ (p—p) $10^{-7}$ | |
| 0.80 | 1.7 | 1.4 |
| 1.00 | 2.3 | 1.9 |
| 1.20 | 3.5 | 2.3 |
| 1.30 | 4.2 | 2.2 |
| 1.40 | 4.6 | 2.6 |
| 1.50 | 5.2 | 3.0 |
| 1.60 | 6.0 | 3.0 |
| 1.65 | 6.5 | 3.1 |
| 1.70 | 7.0 | 3.2 |
| 1.75 | 7.6 | 3.6 |
| 1.80 | 7.9 | 4.1 |
| 1.85 | 8.2 | 5.0 |
| 1.90 | 11.6 | 8.4 |
| 1.95 | 12.3 | 10.4 |

What is claimed is:

1. A process to improve by laser treatment at least one of the magnetic characteristics of grain oriented electrical steel strip, chosen between magnetostriction, induction and core losses, wherein an oriented grain silicon steel strip having already undergone the secondary recrystallisation annealing and provided with final coatings, is treated with a continuous emission laser having a 10.46 $\mu$m wave length, by continuously scanning the strip in motion in a transversal direction with respect to the motion direction of the same strip, thus producing on the strip surface a plurality of traces according to the scanning path, characterized in that the following previously chosen process parameters: specific radiation energy, dwell time and distance between two consecutive traces of the laser beam on the steel strip are contemporarily and continuously adjusted respectively within the following ranges 0.1 to 25 mJ/mm$^2$, $1\times10^{-6}$ and $1\times10^{-2}$ s, 2 and 12 mm, while measuring the value of the above magnetic characteristics before and after the laser beam treatment, the variation in value of such characteristics being utilized to adjust the value of the process parameters.

2. A process according to claim 1 characterized by the fact that the specific radiation energy is between 2 and 8 mJ/mm$^2$.

3. A process according to claim 2 wherein the specific radiation energy is between 3 and 5 mJ/mm$^2$.

4. A process according to claim 1 wherein the dwell time is between $1\times10^{-5}$ and $1\times10^{-3}$ s.

5. A process according to claim 4 wherein the dwell time is between $1\times10^{-4}$ and $8\times10^{-4}$ s.

6. A process according to claim 1, wherein the distance between two consecutive traces is kept in the range between 3.5 and 8 mm.

7. A process according to claim 6 wherein the distance between two consecutive traces is kept at a value 10–20% lower than the average grain size.

8. A process according to claim 1, wherein the value of following further process parameters (i) scanning speed of the laser beam, (ii) transversal sizes of laser beam spot and (iii) rotation speed of the polygonal mirror of the laser optic system, is respectively adjusted between 800 and 10,000 m/min., 1 and 60 mm, 100 and 10,000 rev/min.

9. A process according to claim 8 wherein the scanning speed is between 1500 and 6000 m/min.

10. A process according to claim 8, wherein the transversal sizes of the laser beam are between 5 and 50 mm.

11. A process according to claim 10 wherein the transversal sizes are between 7 and 40 mm.

12. A process according to claim 8 wherein the rotation speed of said polygonal mirror is between 600 and 6,000 rev/min.

* * * * *